US011453530B2

(12) United States Patent
Santini

(10) Patent No.: US 11,453,530 B2
(45) Date of Patent: Sep. 27, 2022

(54) COMPOSITE CLOSURE WITH SUPPORT BRACE AND METHOD FOR MAKING THE SAME

(71) Applicant: TECNOCAP, LLC, Glen Dale, WV (US)

(72) Inventor: Federico Santini, Wheeling, WV (US)

(73) Assignee: TECNOCAP, LLC, Glen Dale, WV (US)

( * ) Notice: Subject to any disclaimer, the term of this patent is extended or adjusted under 35 U.S.C. 154(b) by 0 days.

(21) Appl. No.: 15/774,830

(22) PCT Filed: Nov. 10, 2016

(86) PCT No.: PCT/US2016/061425

§ 371 (c)(1),
(2) Date: May 9, 2018

(87) PCT Pub. No.: WO2017/083581

PCT Pub. Date: May 18, 2017

(65) Prior Publication Data

US 2018/0327147 A1 Nov. 15, 2018

Related U.S. Application Data

(60) Provisional application No. 62/253,328, filed on Nov. 10, 2015, provisional application No. 62/256,453, filed on Nov. 17, 2015.

(51) Int. Cl.
*B65D 41/04* (2006.01)
*B65D 51/24* (2006.01)

(52) U.S. Cl.
CPC ..... *B65D 41/0492* (2013.01); *B65D 51/245* (2013.01)

(58) Field of Classification Search
CPC ..... B65D 41/0492; B65D 51/245; B65D 41/0478; B65D 41/0457; B65D 41/12;
(Continued)

(56) References Cited

U.S. PATENT DOCUMENTS 1,974,438 A 9/1934 Williams et al.
2,031,979 A * 2/1936 Rasmussen ..... B65D 41/0492 215/334

(Continued)

FOREIGN PATENT DOCUMENTS

EP 0897876 2/1999
EP 3374280 A1 9/2018

(Continued)

OTHER PUBLICATIONS

"European Application Serial No. 16865043.0, Extended European Search Report dated Jul. 9, 2019", 9 pages.

(Continued)

*Primary Examiner* — Ernesto A Grano
(74) *Attorney, Agent, or Firm* — Schwegman Lundberg & Woessner, P.A.

(57) ABSTRACT

A composite closure assembly includes a closure shell having a closure socket surrounded by a shell wall and a shell end. An inner closure is within the closure socket. The inner closure is fixed to the closure shell. The inner closure includes a closure wall and a closure end. A closure gap is between the shell end and the closure end. A support brace including one or more support braces extends from the closure end to the shell end and bridges the closure gap.

33 Claims, 10 Drawing Sheets

(58) Field of Classification Search
CPC ..... B65D 41/14; B65D 41/40; B65D 17/508; B65D 43/0231; B65D 55/04; B65D 55/063
USPC ..... 215/334, 329
See application file for complete search history.

(56) References Cited

U.S. PATENT DOCUMENTS

| | | | | |
|---|---|---|---|---|
| 2,036,408 | A * | 4/1936 | Goebel | B65D 41/0492 215/334 |
| 2,041,403 | A * | 5/1936 | Fergusson | B65D 41/045 215/334 |
| 2,041,768 | A * | 5/1936 | Kohrer | B65D 41/0492 215/334 |
| 2,042,028 | A * | 5/1936 | Skutch | B65D 41/0492 215/334 |
| 2,089,007 | A * | 8/1937 | Skutch | B65D 41/0492 215/334 |
| 2,133,298 | A * | 10/1938 | Kaufman | B65D 41/0492 220/288 |
| 2,137,695 | A * | 11/1938 | Merolle | B65D 41/0492 215/334 |
| 2,170,386 | A * | 8/1939 | Merolle | B65D 41/0492 215/334 |
| 2,233,105 | A * | 2/1941 | McCombs | B65D 41/0492 215/334 |
| 2,262,021 | A * | 11/1941 | Lockwood | B65D 41/0492 215/334 |
| 2,263,472 | A * | 11/1941 | Reichenbach | B65D 41/0492 215/334 |
| 2,398,553 | A * | 4/1946 | Nyden | B65D 41/0492 215/334 |
| 2,587,737 | A | 3/1952 | Koster | |
| 2,744,647 | A * | 5/1956 | Wheaton | B65D 41/0492 215/334 |
| 2,791,343 | A | 5/1957 | Franck | |
| 2,804,225 | A * | 8/1957 | Lee | B65D 41/045 215/262 |
| 2,850,194 | A * | 9/1958 | Williams | B65D 41/0492 215/334 |
| 3,199,704 | A * | 8/1965 | Davidson | B65D 41/0492 215/334 |
| 3,303,953 | A * | 2/1967 | Frankwalterr | B65D 41/0492 215/228 |
| 3,315,830 | A | 4/1967 | Flynn | |
| 4,093,096 | A * | 6/1978 | Augros | B65D 41/0414 215/330 |
| 4,251,003 | A | 2/1981 | Bodenmann | |
| 4,271,974 | A * | 6/1981 | Quinard | B65D 41/0478 215/331 |
| 4,273,248 | A * | 6/1981 | Lehmann | B65D 41/0478 215/331 |
| 4,280,632 | A | 7/1981 | Yuhara | |
| 4,319,690 | A | 3/1982 | Birrell et al. | |
| 4,597,501 | A * | 7/1986 | Gueret | B65D 41/0435 215/330 |
| 5,147,052 | A * | 9/1992 | Minette | B65D 50/041 215/215 |
| 6,761,275 | B1 * | 7/2004 | McBride | B65D 53/04 215/349 |
| 2006/0043050 | A1 | 3/2006 | Belden, Jr. | |
| 2006/0213862 | A1 | 9/2006 | Smith | |
| 2010/0012615 | A1 * | 1/2010 | Brooks | B65D 45/322 215/256 |
| 2015/0114967 | A1 * | 4/2015 | Brandriff | B65D 41/0414 220/327 |

FOREIGN PATENT DOCUMENTS

| | | |
|---|---|---|
| FR | 2629428 | 10/1989 |
| FR | 2784658 | 4/2000 |
| WO | WO-201 7083581 A1 | 5/2017 |
| ZA | 201802601 | 7/2019 |

OTHER PUBLICATIONS

"International Application Serial No. PCT/US2016/061425, International Search Report dated Jan. 5, 2017", 2 pgs.
"International Application Serial No. PCT/US2016/061425, Written Opinion dated Jan. 5, 2017", 7 pgs.
"International Application Serial No. PCT/US2016/061425, International Preliminary Report on Patentability dated Aug. 3, 2018", 7 pgs.
"European Application Serial No. 16865043.0, Communication Pursuant to Article 94(3) EPC dated May 4, 2020", 8 pgs.
"Brazilian Application Serial No. BR112018008824-2, Office Action dated May 25, 2020", with English translation, 5 pages.
"Brazilian Application Serial No. BR112018008824-2, Response filed Office Action dated May 25, 2020", with English claims, 53 pages.
"European Application Serial No. 16865043.0, Response filed Oct. 27, 2020 to Communication Pursuant to Article 94(3) EPC dated May 4, 2020", 16 pgs.
"European Application Serial No. 16865043.0, Communication Pursuant to Article 94(3) EPC dated Dec. 4, 2020", 6 pgs.
"Australian Application Serial No. 2016353152, First Examination Report dated May 19, 2021", 4 pgs.
"European Application Serial No. 16865043.0, Response filed Jun. 1, 2021 to Communication Pursuant to Article 94(3) EPC dated May 4, 2020", 18 pgs.
"Australian Application Serial No. 2016353152, Response filed Apr. 13, 2022 to Subsequent Examiners Report dated Apr. 7, 2022", 18 pgs.
"Australian Application Serial No. 2016353152, Subsequent Examiners Report dated Apr. 7, 2022", 5 pgs.
"Mexican Application Serial No. MX a 2018 005843, Office Action dated May 24, 2022", with machine English translation, 13 pages.
"Brazilian Application Serial No. BR112018008824-2, Opinion for non-patentability (RPI 7.1) dated May 18, 2022", w/ English translation, 9 pgs.
"European Application Serial No. 16865043.0, Communication Pursuant to Article 94(3) EPC dated Jul. 1, 2022", 5 pgs.
"Australian Application Serial No. 2016353152, Response filed Dec. 23, 2021 to First Examination Report dated May 19, 2021", 34 pages.
"Australian Application Serial No. 2016353152, Subsequent Examiners Report dated Jan. 28, 2022", 5 pages.
"Australian Application Serial No. 2016353152, Response filed Feb. 28, 2022 to Subsequent Examiners Report dated Jan. 28, 2022", 18 pages.

* cited by examiner

COMPOSITE CLOSURE WITH SUPPORT BRACE AND METHOD FOR MAKING THE SAME

CLAIM OF PRIORITY

This application is a U.S. National Stage Application filed under 35 U.S.C. § 371 from International Application Serial No. PCT/US2016/061425, filed on Nov. 10, 2016, and published as WO 2017/083581 on May 18, 2017, which claims the benefit of priority to U.S. Provisional Application Ser. No. 62/253,328, filed on Nov. 10, 2015 and U.S. Provisional Application Ser. No. 62/256,453, filed on Nov. 17, 2015. The contents of the above applications are incorporated herein by reference in their entireties.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Tecnocap, LLC; Glen Dale, W. Va. All Rights Reserved.

TECHNICAL FIELD

This document pertains generally, but not by way of limitation, to closures, for instance closures used with containers.

BACKGROUND

Some examples of decorative closures for containers such as bottles include a decorative shell coupled over a smaller inner closure. The inner closure includes features, such as threads, to fasten the decorative closure to the container. The decorative shell provides a veneer for the inner closure that is aesthetically pleasing, for instance the decorative shell has a smooth exterior appearance and stands taller than the inner closure.

The decorative shell, in at least some examples, is coupled with the polymer closure with a downward force that drives the decorative shell over top of the polymer closure. The polymer closure is received within the decorative shell. Optionally, an adhesive is applied between the polymer closure and the decorative shell to fix the polymer closure relative to the decorative shell. Fixing of the polymer closure and the decorative shell allows the user to twist on and off the decorative closure without relative movement (slipping) between the polymer closure and the decorative shell.

Overview

The present inventors have recognized, among other things, that a problem to be solved can include minimizing (e.g., reducing or eliminating altogether) deformation and crushing of closure shells (e.g., decorative shells) coupled with closures. Closure shells are, in some examples, taller than the inner closures received within the shells. For instance a closure gap is provided between the end of the closure shell and the end of the inner closure. The taller shell provides a decorative appearance to the composite closure.

During application of the composite closure to the bottle, downward pressure is exerted on the top of the closure shell. In some examples, the downward force applied to the closure shell crushes the shell around the inner closure. For instance, the closure shell collapses into the space provided by the closure gap between the ends of the closure shell and the inner closure. Crushed composite closures are not usable and are discarded. In at least some examples, precise control of the downward (and optional rotational) force is difficult during coupling of the composite closure to the container. For instance, one or more of force or torque measurements are inaccurate and may precipitate the application of force or torque that crushes the composite closure as it is coupled with the container.

The present subject matter can help provide a solution to this problem, such as by providing one or more support braces that bridge the closure gap between the closure shell and the inner closure within the closure shell. In one example, the one or more support braces are formed with the inner closure (e.g., molded). In other examples, the one or more support braces are part of the closure shell or a interposed between the closure shell and the inner closure. The one or more support braces provide a mechanical support between the inner closure and the closure shell that minimizes (e.g., reduces or eliminates) crushing of the closure shell in and around the closure gap.

Further, the one or more support braces support the interface between the closure shell and the inner closure, for instance, during manufacture, transport and use (opening or closing, for instance with rotation of the assembly). One or more of clamping, crimping or adhesive interfaces (or the like) are provided between the closure shell and the inner closure fix the components together and allow transmission of rotation and upward and downward forces from the closure shell (e.g., by hand operation) to the inner closure. The stresses introduced by these forces are experienced by one or more of the interfaces and may cause failure of the interface and slipping therebetween. Accordingly, the closure shell will rotate relative to the inner closure and frustrate operation of the closure assembly (e.g., rotation will not cause twisting off or on of the assembly).

The one or more support braces support these interfaces by providing a mechanical support between the closure shell and the inner closure (bridging the closure gap) in addition to the interface (e.g., one or more of adhesives, crimping, clamping or the like). Accordingly, downward forces that in some examples decouple the closure shell from the inner closure through sliding of the closure shell over the inner closure are distributed between the one or more support braces and the interface. The interface experiences less overall stress and is able to maintain its integrity consistently and correspondingly prevent failure (slipping) between the closure shell and the inner closure.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

In at least some examples the closure assemblies described herein include a cap (inner closure) glued to a metallic cap (e.g., a closure shell). In other examples one or both of the inner closure and the closure shell are constructed with metallic components, polymer components or the like.

Figure 8:
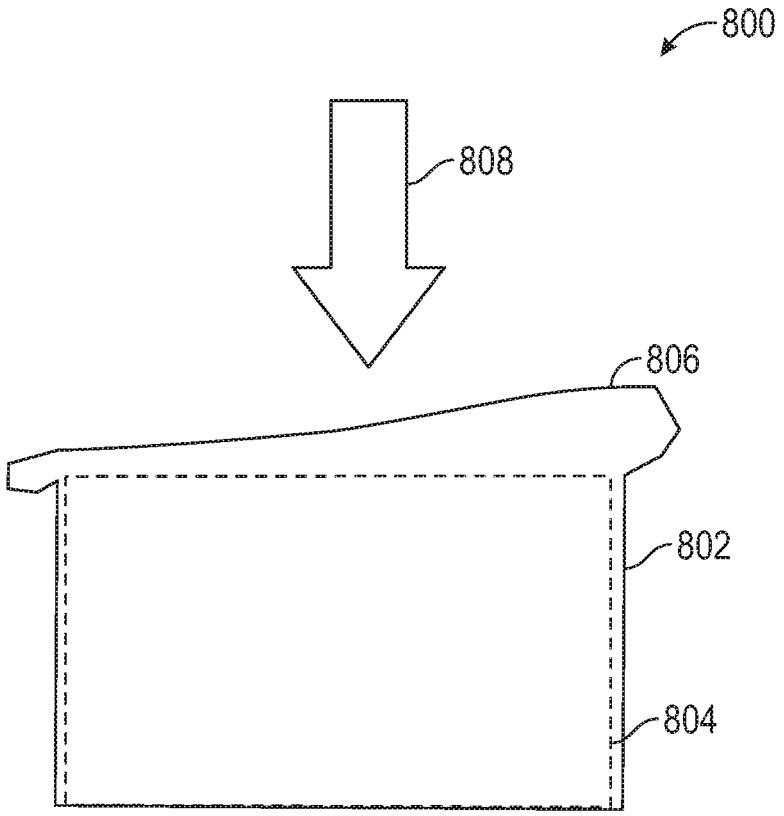
FIG. 8 is a side view of one example of a failed closure assembly.

The closure shells described herein are coupled with inner closures at least with a downward force. Further, the closure assemblies are coupled with a container or vessel, such as a bottle, with simultaneous downward force and a rotating force to twist the closure assembly on to the bottle. The closure assembly, in some examples, is crushed during assembly or coupling with a vessel because of the gap and corresponding lack of support between the closure shell and the inner closure. Further, it is difficult to apply the specified assembly or closing torque or force (e.g., one or more of rotational or downward forces) to the composite closure assemblies in a consistent manner. Instead, one or more of torque or force sensors inaccurately measure (too little) torque or force applied and the larger torque or force loads cause crushing as shown in FIG. 8 and described herein.

The composite closure assemblies described herein includes at least two components, an inner closure (e.g., a polymer inner closure) and a closure shell (e.g., a metallic closure shell, such as aluminum). One or more support braces (e.g., ribs, fins, posts, walls, rings or the like) are provided between the inner closure and the closure shell. As shown herein, in one example the one or more support braces include a plurality of support braces. In another example, the one or more support braces are provided to one or both of the ends of the inner closure or the closure shell. In still another example, the one or more support braces are provides to a shell end of the closure shell. In yet another example, the one or more support braces are provided to a closure end of the inner closure. In an additional example, the one or more support braces are separate components from the inner closure and the closure shell and installed therebetween (e.g., as one or more inserts). Optionally, the closure shell is fixed to the inner closure, for instance with one or more of adhesives, crimping, clamping, rolling (including forming) of lips over portions of either of the closure shell or the inner closure or the like.

Figure 1:
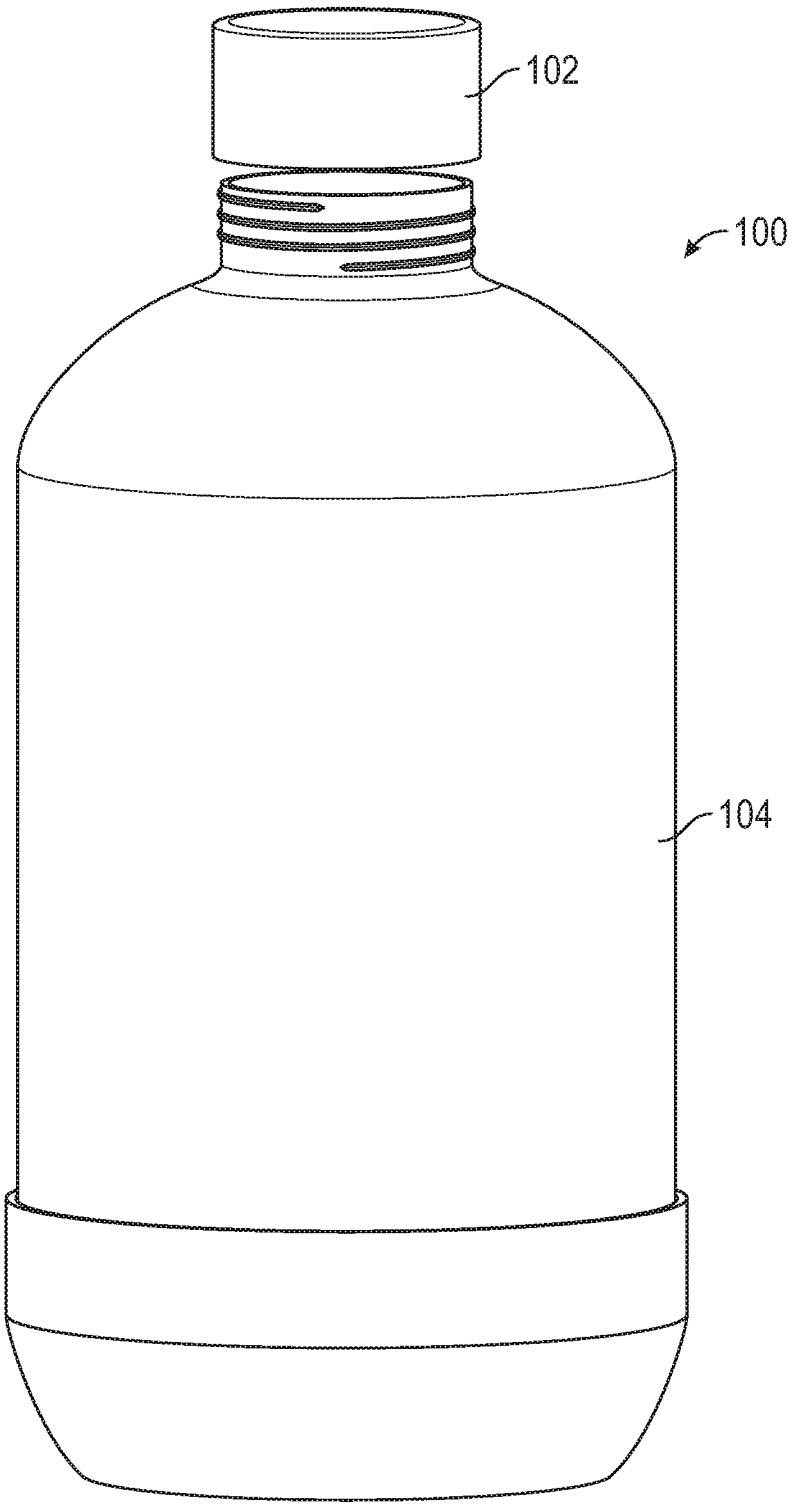
FIG. 1 is a perspective view of one example of a container assembly including a composite closure assembly.

FIG. 1 shows one example of a container assembly 100 including a container 104 and a composite closure assembly 102. As described herein, the composite closure assembly 102 includes an inner closure and a closure shell surrounding the inner closure. In another example, the composite closure assembly 102 includes both the inner closure and the surrounding closure shell as well as the container such as the container 104 shown in FIG. 1. As further shown in FIG. 1, the composite closure assembly 102 is coupled with the container 104. The composite closure assembly 102 is coupled with the container with one or more fasteners including, but not limited to, threaded engagement, interference fits, frangible couplings or the like. The container 104 is, in one example, configured to hold a fluid, for instance, water, carbonated beverages, alcohol, cleaning solutions, gases or the like.

Figure 2A:
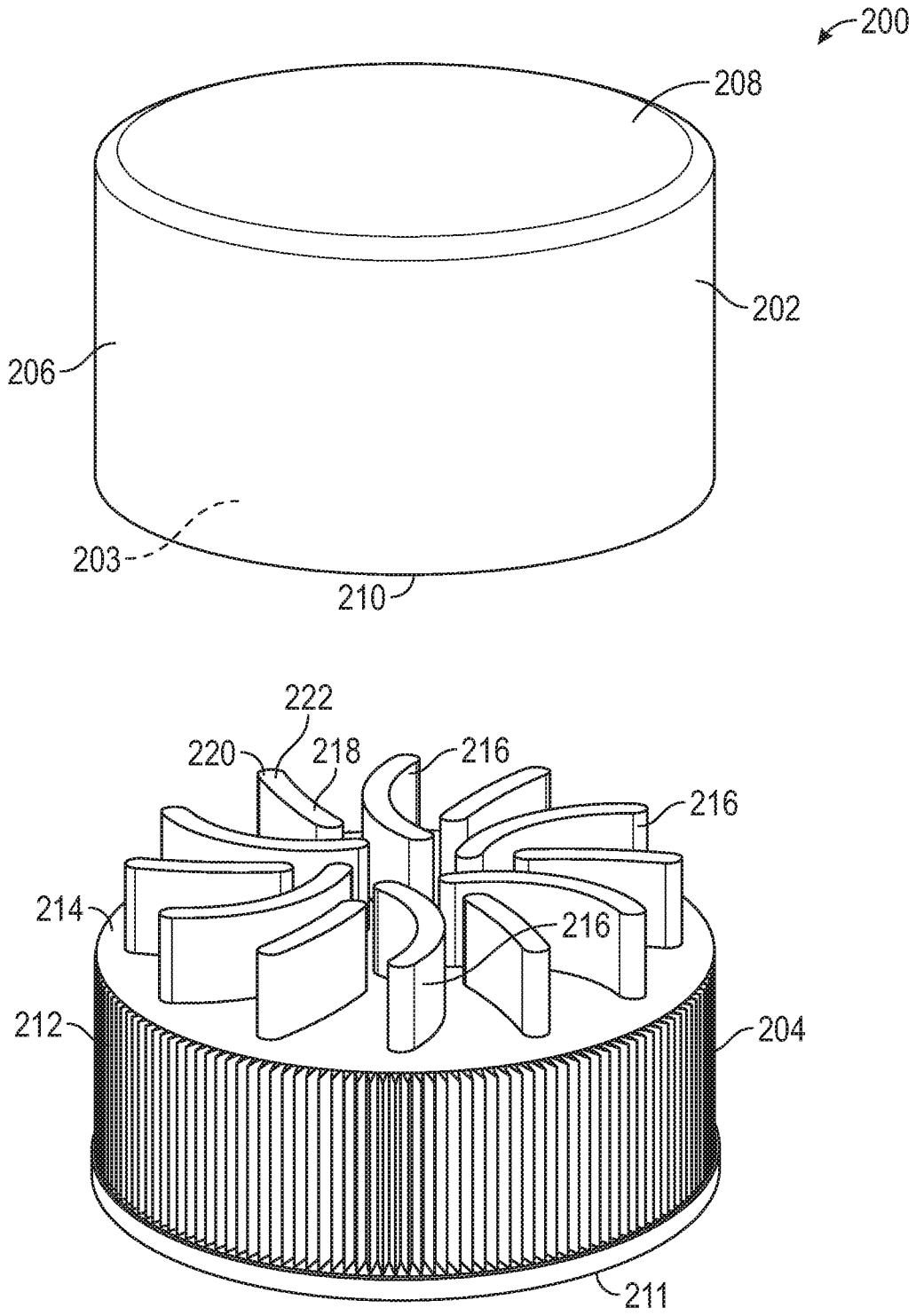
FIG. 2A is an exploded view of one example of a composite closure assembly.

FIG. 2A shows an exploded view of one example of a composite closure assembly 200. As previously described herein, the composite closure assembly 200 includes a closure shell 202 and an inner closure 204 provided within a closure socket 203 of the shell 202. The closure shell 202 includes a shell end 208 and a shell wall 206 extending from the shell end 208. As shown, the shell wall 206 and the shell end 208, in one example, include a smooth surface, for instance, a planar surface extending across the shell wall 206 and the shell end 208. In another example, the shell wall 206 and the shell end 208 include one or more of decorative coloring, printing, embossing, or the like configured to provide one or more of textual, pictorial, illustrations, contours or the like. The closure shell 202 further includes a shell open end 210 sized and shaped to provide an opening within the closure shell 202 for reception of the inner closure 204, for instance, within a closure socket 203 surrounded by the shell wall 206 and the shell end 208.

Referring again to FIG. 2A, as further shown the composite closure assembly 200 includes the inner closure 204 configured for reception within the closure socket 203 of the closure shell 202. The inner closure 204 includes a closure wall 212 and a closure end 214. The closure wall 212, in one example, extends from the closure end 214, for instance, toward a closure open end 211 of the inner closure 204. The closure opening 211 is configured to receive a portion of a work piece, such as the container 104 or vessel (e.g., neck, nozzle or the like) shown in FIG. 1 to couple with the composite closure assembly 200. In one example, the interior of the inner closure 204, for instance, along the interior of the closure wall 212 is provided with one or more coupling features such as threading 230 (FIG. 2B), interference fit features, grooves or the like configured to cooperate with corresponding threading, interference fit features, grooves or the like on the container 104 to facilitate the coupling of the composite closure assembly 200 to the container.

The inner closure 204 shown in FIG. 2A further includes one or more support braces 216 extending across at least a portion of the closure end 214. In the example shown, the one or more support braces 216 include, but are not limited to, one or more of ribs, walls, fins, posts or the like extending from the closure end 214 (for instance, toward the closure shell 202 as shown in the exploded view of FIG. 2A) and laterally, for instance, from an interior portion of the closure end 214 toward the periphery of the closure end 214, for instance, adjacent to the closure wall 212. In another example, the support braces 216 extend from inner ends 218 to outer ends 220. As shown in FIG. 2A, the inner end 218 is, in one example, remote from the closure wall 212 while the outer end 220 of one or more of the support braces 216 is adjacent to or near the closure wall 212. As further shown in FIG. 2A, a brace wall 222 (e.g., straight, curved as shown, zigzagged or the like) extends between the inner and outer ends 218, 220 to provide the support brace 216 in a continuous or near continuous manner extending from an inner portion of the closure end 214 to the perimeter of the closure end 214 (e.g., adjacent to the closure wall 212).

In still other examples, the support brace 216 includes one or more fins, posts, walls, rings or the like provided on the closure end 214 to span a closure gap otherwise provided between the inner closure 204 and the closure shell 202. As shown in FIG. 2A, in one example, the support brace 216 optionally includes a plurality of support braces 216, for instance, separated braces 216 on the closure end 214. Optionally, the support brace 216 includes a plurality of elements formed as separate or interconnected elements (e.g., walls with fins extending therefrom, continuous rings, interconnected walls, posts or the like).

In other examples, the one or more support braces 216 are provided on an interior surface of the closure shell 202. For instance, the one or more support braces 216 extend from the shell end 208 within the closure socket 203 toward the closure end 214 of the inner closure 204. In yet another example, the one or more support braces 216 are provided as a separate component, for instance, as an insert or the like provided between the shell end 208 and the closure end 214 of the respective closure shell 202 and the inner closure 204. That is to say, in at least one example the support brace 216 is provided as a separate component from each of the closure shell 202 and the inner closure 204 to accordingly facilitate the selection and incorporation of one or more types or variations of the support brace 216 with existing closure shells 202 and inner closures 204. The separate support brace 216 is adhered, mechanically fastened or the like with one or more of the inner closure 204 and the closure shell 202 or optionally interposed therebetween and captured during assembly of the assembly 200. For instance, in one example, an adhesive is applied to features of the support brace 216 facing the shell end 208 of the closure shell 202 and the closure end 214 of the inner closure 204 fix the support brace 216 therebetween.

When assembled, the inner closure 204 is positioned within the closure socket 203. The inner closure 204 is positioned within the closure socket 203 and the support brace 216 is provided within a closure gap (226 in FIG. 2B) between the closure end 214 and the shell end 208. The support brace 216 accordingly provides support (e.g., bracing, reinforcement, structural support or the like) to the closure shell 202. In one example, the support brace 216 provides support between the inner closure 204 and the closure shell 202 to substantially prevent (e.g., minimize or eliminate) the crushing, deformation or damaging of the closure shell 202 while being coupled with the inner closure 204.

Figure 2B:
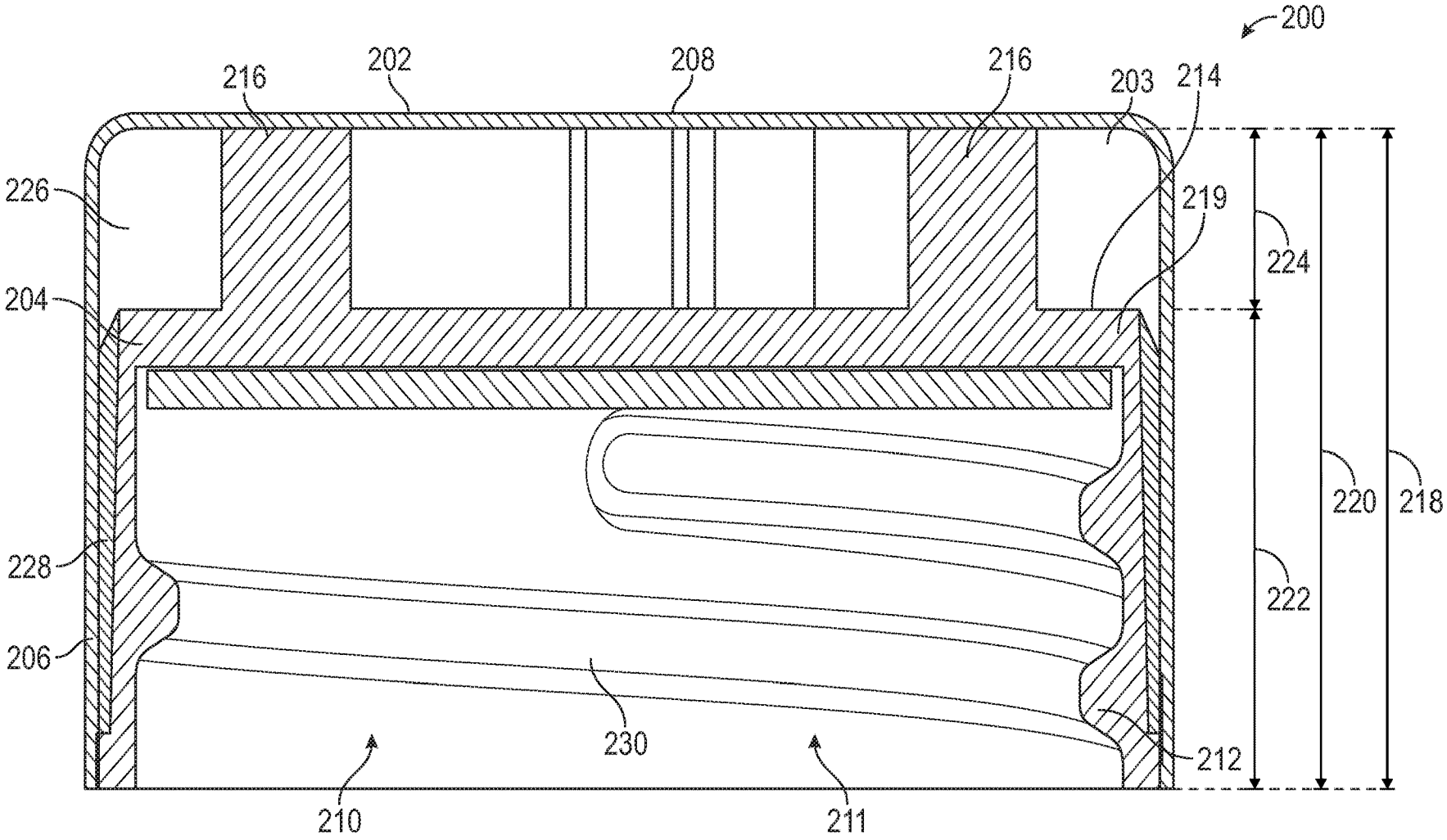
FIG. 2B is a cross sectional view of the composite closure assembly of FIG. 2A.

FIG. 2B shows a cross sectional view of the composite closure assembly 200 in an assembled configuration. As shown, the inner closure 204 is received through the shell open end 210 and correspondingly received within the closure socket 203. With the support brace 216, such as one or more support braces 216, interposed between the shell end 208 and the closure end 214 a closure gap 226 is spanned by the support braces 216. In the example shown in FIG. 2B, the one or more support braces 216 are included as a component of the inner closure 204 and extend from the closure end 214 to the shell end 208 of the closure shell 202. The one or more support braces 216 provide support (e.g., bracing, reinforcement, structural support or the like) to the closure shell 202. During assembly of the closure shell 202 to the inner closure 204 or coupling of the composite closure assembly 200 with a container with one or more of longitudinal or rotational forces applied to the closure shell 202 over the inner closure 204 forces incident on the closure shell 202 (sufficient to cause damage to the shell) are countered by structural support provided by the support braces 216. In another example, the one or more support braces 216 cooperate with the inner closure 204 to provide support to the closure shell 202 (e.g., support provided by the inner closure is passed to the closure shell through the support braces 216).

Accordingly, with the one or more support braces 216 the closure shell 202 (e.g., formed with a deformable or easily damaged material such as aluminum or the like) maintains the desired shape, finish or the like. Crushing and other phenomenon such as damage to the closure shell 202 are thereby substantially prevented (e.g., minimized or eliminated) with the support braces 216 coupled between the closure shell 202 and the inner closure 204.

As further shown in FIG. 2B, a closure socket height 218 is shown, for instance, in the rightmost bracket provided in FIG. 2B. As shown, the closure socket height 218 extends from the shell end 208 to the shell open end 210 of the closure shell 202. The inner closure height 220 adjacent to the closure socket height 218 is identical (e.g., the same or substantially the same) to the closure socket height 218. As further shown in FIG. 2B, in one example, the inner closure height 220 includes both a support brace height 224 as well as a closure wall height 222 of the closure wall 212. The support brace height 224 spans the closure gap 226 and accordingly increases the effective height of the inner closure 204. As previously described herein, the support brace 216 (and its corresponding height 224) is in one example a separate component from the shell 202 and the closure 204 or a component of the closure shell 202. The support brace height 224 in combination with the closure wall height 222 is identical (e.g., the same or substantially the same) as the closure socket height 218.

When assembled as shown in FIG. 2B, the inner closure 204 is coupled relative to the closure shell 202 with one or more features including, but not limited to, adhesives, mechanical couplings such as clamps, interference fits, crimping, rolling (including forming) of lips or the like. In the example shown in FIG. 2B, an adhesive 228 is provided between the shell wall 206 and the closure wall 212 to reliably couple the inner closure 204 with the closure shell 202. In another example, the support braces 216 cooperate with the adhesive 228 to enhance the coupling between the inner closure 204 and the closure shell 202. For instance, the support braces 216 of the inner closure 204 are coupled with corresponding features such as recesses, ridges or the like in the closure shell 202 to facilitate the coupling with the shell in combination with adhesives, rolling or the like provided between the inner closure 204 and the closure shell 202. In yet another example, an adhesive is applied between the support braces 216 and the shell end 208 to provide an adhesive coupling between the inner closure 204 and the closure shell 202.

In another example, and as described herein, a mechanical engagement feature is provided between the closure shell 202 and the inner closure 204 to couple the inner closure with the closure shell. For instance, in one example, the lower lip of the closure shell 202 is rolled, for instance, over a corresponding portion of the inner closure 204 (a bottom lip of the inner closure) to fix the closure shell 202 relative to the inner closure 204. One or more of the adhesive 228, mechanical coupling, the support brace 216 or the like reliably couple the inner closure 204 with the closure shell 202. Accordingly, during use of the composite closure assembly 200, for instance, when twisting on or off the composite closure assembly 200 relative to a vessel such as the container 104, the closure shell 202 remains in non-rotatable contact with the inner closure 204 to reliably transmit rotation from the closure shell 202 (e.g., provided by hand) to the inner closure 204 and rotate the composite closure assembly 200 relative to the container 104. Failure of the adhesive or other mechanical coupling is, in one example, minimized (e.g., eliminated or minimized), with the addition of the support brace 216 to provide additional coupling or engagement (e.g., including one or more of adhesives or fitting of the support braces with corresponding components) to minimize (e.g., minimize or eliminate) the decoupling of the closure shell 202 from the inner closure 204. The composite closure assembly 200 including, for instance, the one or more support braces 216 described herein optionally provide enhanced coupling between the inner closure 204 and the closure 202 (along with the support described herein) to facilitate the reliable operation of the composite closure assembly 200 over the lifetime of use.

Accordingly, in addition to minimizing the deformation, damage, crushing or the like of the closure shell 202 with the support braces 216, the support braces 216 (one or more support braces 216) in at least some examples also cooperate with adhesives 228, mechanical engagement or the like to enhance the coupling between the inner closure 204 and the closure shell 202.

Figure 3A:
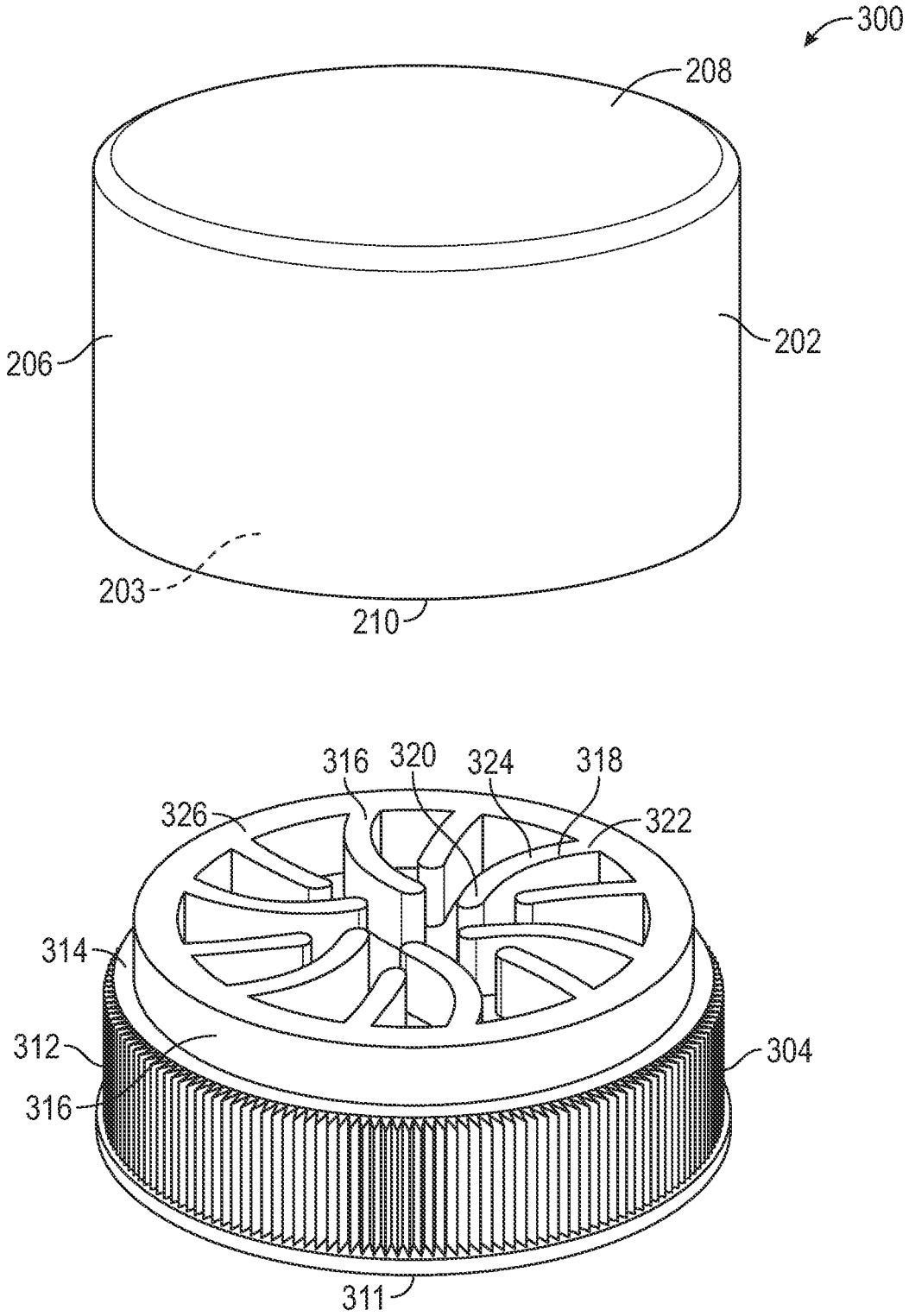
FIG. 3A is an exploded view of another example of a composite closure assembly.
Figure 3B:
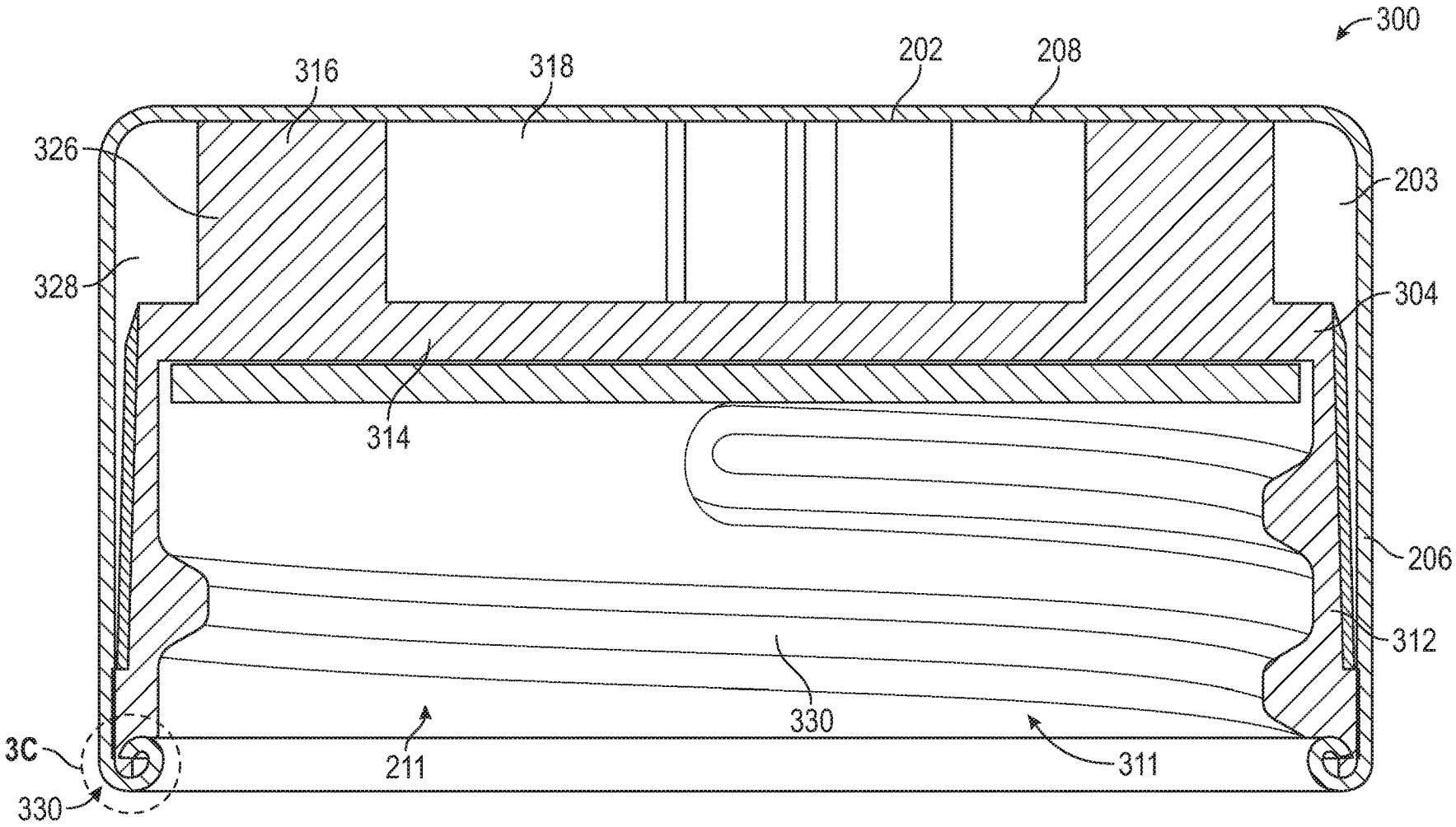
FIG. 3B is a cross sectional view of the composite closure assembly of FIG. 3A.

FIGS. 3A and 3B shown another example of a composite closure assembly 300. In at least some regards, the composite closure assembly 300 is similar to the composite closure assembly 200 shown in FIGS. 2A and 2B. In the example shown in FIG. 3A, the composite closure assembly 300 is shown in an exploded view with the closure shell 202 at an elevated position relative to the inner closure 304. The closure shell 202 includes a shell end 208 and a shell wall 206 extending from the shell end 208. As further shown in FIG. 3A, the closure shell 202 includes a shell open end 210 providing access to a closure socket 203 within the closure shell 202 and surrounded by the shell end 208 and the shell wall 206. The closure shell 202 (e.g., the closure socket 203) is sized and shaped for reception of the inner closure 304 therein.

As shown in FIG. 3A (and also shown in FIG. 3B) the inner closure 304 including, for instance, its closure wall 312 has a height less than the wall height of the shell wall 206. Accordingly, a closure gap 328 is provided between the closure end 314 and the shell end 208 of the closure shell 202. When the inner closure 304 is received within the closure socket 203, the closure gap between each of the closure end 314 and the shell end 208 is bridged, for instance, with one or more support braces 316.

As further shown in FIG. 3A, the inner closure 304 is provided below the closure shell 202 in the exploded view. The inner closure 304 includes a closure wall 312 and a closure end 314. A closure open end 311 is provided at an opposed end of the closure wall 312 relative to the closure end 314. In one example, the closure open end 311 provides access to the inner closure 304, for instance, by the neck of a container or other vessel for coupling of the inner closure 304 with the container to close the container.

As further shown in FIG. 3A, in one example, the inner closure 304 includes one or more support braces 316. In the example shown in FIG. 3A, the support brace 316 includes, in this example, a ring 326 and one or more support elements 318. In this example, the one or more support elements 318 extend from the ring 326, for instance, in an inward fashion toward a middle portion of the closure end 314 (e.g., or away from the closure wall 312). As shown, the example support elements 318 each include an inner end 320 and an outer end 322 with the outer end 322 adjacent to the ring 326. An element wall 324 extends between the inner and outer ends 320, 322 to form each of the support elements 318. As further shown in FIG. 3A, each of the support elements 318 is coupled with or formed integrally with the ring 326. Accordingly, the ring 326, in one example, provides a reinforcing or bracing feature for each of the support elements 318 to cooperatively ensure support of each of the support elements 318 and the ring 326 and provide enhanced support of the support brace 316 between the shell end 208 and the closure end 314.

Although the support brace 316 as shown in FIG. 3A is a ring 326, the ring 326 does not necessarily include a continuous or circular shape. For instance, the ring 326 includes one or more of a discontinuous ring extending around a perimeter of the closure end 314, a continuous ring extending around the perimeter of the closure end 314, a non-circular ring 326 extending across the closure end 314 (adjacent the closure wall 312 or away from the 312), or the like. Similarly, the support elements 318 as shown in FIG. 3A, in one example, extend inwardly from the ring 326 toward a middle or interior portion of the closure end 314. In another example, the ring 326 is provided medially along the closure end 314 and one or more support elements 318 extend outwardly from the ring 326, inwardly or the like. In still another example, the ring 326 is included closer to the interior portion of the closure end 314 and one or more support elements 318 extend away from the ring 326, for instance toward the perimeter of the closure end 314 adjacent to the closure wall 312. A plurality of examples of support braces are shown herein, for instance, in FIGS. 2A, B as previously described as well as in FIGS. 4-7 as further described herein.

Referring now to FIG. 3B, the inner closure 304 is shown seated within the closure socket 203 of the closure shell 202. The support brace 316 spans the closure gap 328 and supports the closure shell 202, for instance, against one or more of deformation, crushing, damage or the like, for instance, during assembly of the composite closure assembly 300, coupling of the assembly with a container or the like. As further shown in FIG. 3B, the ring 326, in this example, provides a support feature adjacent to the closure wall 312 (and on the closure end 314). The ring 326 as well as the support elements 318 cooperate to provide additional bracing to the support brace 316 to further enhance support of the closure shell 202, for instance, during assembly of the closure shell 202 to the inner closure 304, use of the composite closure assembly 300 (e.g., during twisting on or off relative to a container) or the like.

In another example, the support brace 316 is provided as a component of the closure shell 202. As previously described herein, in one example, the support brace 216, including one or more of the ring 326 and the support elements 318, are provided on an inner surface of the closure shell 202, for instance, along the shell end 208. The support brace 316, in such an example, engages the closure end 314 during assembly of the inner closure 304 with the closure shell 202 and braces the closure shell 202, including the shell end 208, against deformation, crushing, damage or the like during one or more of assembly or coupling with a container.

In still another example, the support brace 316 as described herein is provided as a separate component relative to the inner closure 304 and the closure shell 202. For instance, the ring 326 provides a framework and the support elements 318 extend from the ring 326. The component (e.g., an insert), including the support brace 316, is interfit between the inner closure 304 and the closure shell 202 to brace the closure shell 202 during assembly.

In another example, and as previously described herein, the support brace 316 is engaged with one or both of the closure shell 202 and the inner closure 304, for instance, by way of one or more of corresponding fittings on either of the closure shell 202 or the inner closure 304, adhering of the support brace 316 including one or more of the ring 326 or the support elements 318 with the opposed feature of the composite closure assembly 300 (e.g., one or more of the closure shell 202 or the inner closure 304), interference fitting or the like. In an example, adhering or coupling of the support brace 316 with an opposed feature of the composite closure assembly (as shown in FIG. 3B the closure shell 202) enhances the mechanical coupling between the closure shell 202 and the inner closure 304.

For instance, in one example, an adhesive 228 as previously described and shown in FIG. 2B is provided between the shell wall 206 and the closure wall 312 to facilitate the mechanical coupling of the inner closure 304 with the closure shell 202 and fix one relative to the other. In another example, the inner closure 304 as shown in FIG. 3B is coupled with the closure shell 202, for instance, with a mechanical engagement 330 as shown in FIG. 3B. Optionally, the mechanical engagement 330 includes crimping, rolling or the like of a lip of the closure shell 202 around a corresponding portion of the inner closure 304.

The mechanical engagement 330 is optionally enhanced by way of mechanical coupling between the support brace 316 and either of the closure shell 202 or the inner closure 304 (e.g., with its own adhesive, interfitting features, interference fit or the like). By further fixing the inner closure 304 to the closure shell 202, for instance with both of a mechanical engagement 330 and coupling of the support brace 316 with the closure shell 202 coupling between the closure shell 202 and the inner closure 304 is enhanced. Accordingly, with engagement of the threading 330 shown in FIG. 3B with corresponding threading of the container the closure shell 202 is reliably coupled with the inner closure 304 even with forceful twisting in the on or off directions.

Figure 3C:
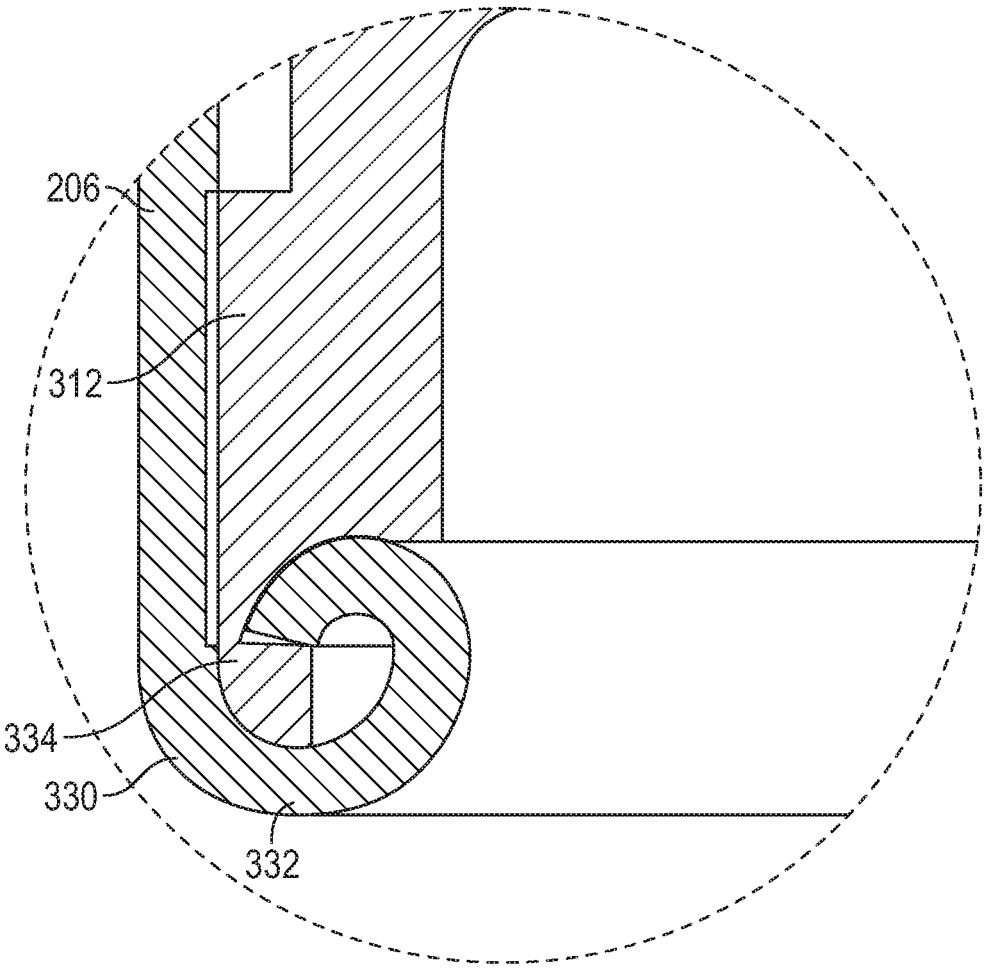
FIG. 3C is a detailed cross sectional view of the composite closure assembly of FIG. 3A including a mechanical engagement between a closure shell and an inner closure.

FIG. 3C shows a detailed cross sectional view of a portion of FIG. 3B. As shown in FIG. 3C, the closure wall 312 of the inner closure 304 is mechanically coupled with the shell wall 206 of the closure shell 202 with the mechanical engagement 330. In this example, the mechanical engagement 330 includes a shell lip 332 deformed around the closure lip 334 of the closure wall 312. Deforming of the shell lip 332 (e.g., rolling, crimping, clamping, compressing or the like) captures the inner closure 304 within the closure shell 202 and immobilizes the inner closure 304 relative to the closure shell 202. As previously described in one example, the mechanical engagement 330 is used in cooperation with coupling of the support brace 316 with one or more of the closure shell 202 or the inner closure 304, for instance, by way of an adhesive.

FIGS. 4-7 show various examples of support braces 400, 500, 600, 700. As described herein, the support braces, whether those shown in FIGS. 4-7 or in FIGS. 2A-3B, provide a variety of different support brace configurations useable, with one or more composite closure assemblies, such as the composite closure assemblies 200, 300 described herein.

Figure 4:
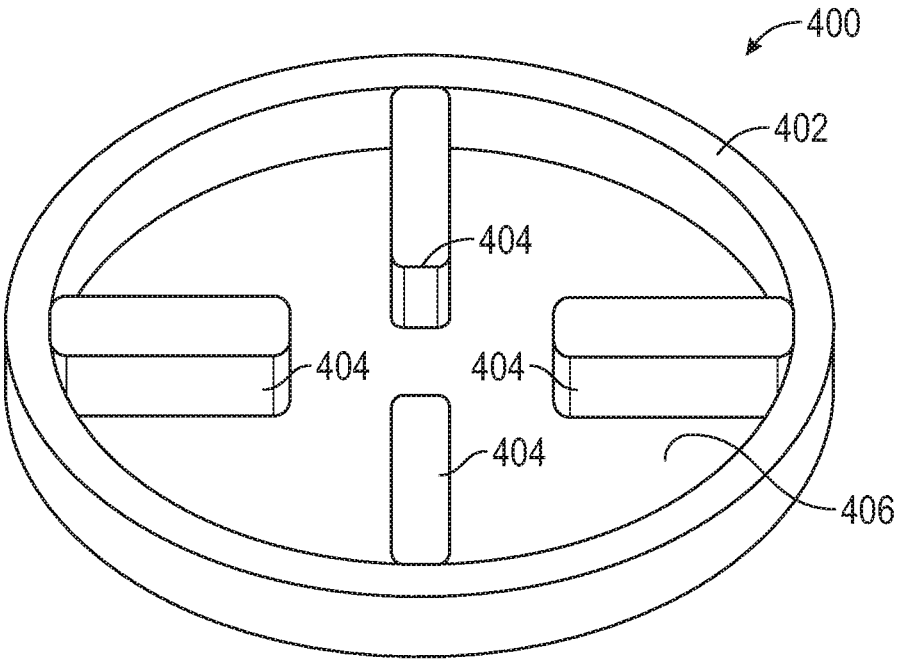
FIG. 4 is a perspective view of one example of a support brace.

Referring first to FIG. 4, one example of a support brace 400 is shown. In this example, the support brace 400 includes a ring 402 extending around a plurality of support elements 404. In the example shown, the support elements 404 extend from the ring 402 toward an interior portion of the support brace 400. Optionally, the support brace 400 includes a brace end 406 and one or more of the ring 402, support elements 404 or the like extend from the brace end 406. In one example, the brace end 406 includes a panel, base or the like formed from the same material as the ring 402 and support elements 404. For instance, the support brace 400 (or other example support braces described herein) includes molded plastic such as a thermoplastic, thermoset plastic or the like. In another example, the support brace 400, including any of the support braces described herein, is machined, punched, cut or the like from one or more billets or blanks of material including, for instance, aluminum, steel, tin or the like.

Figure 5:
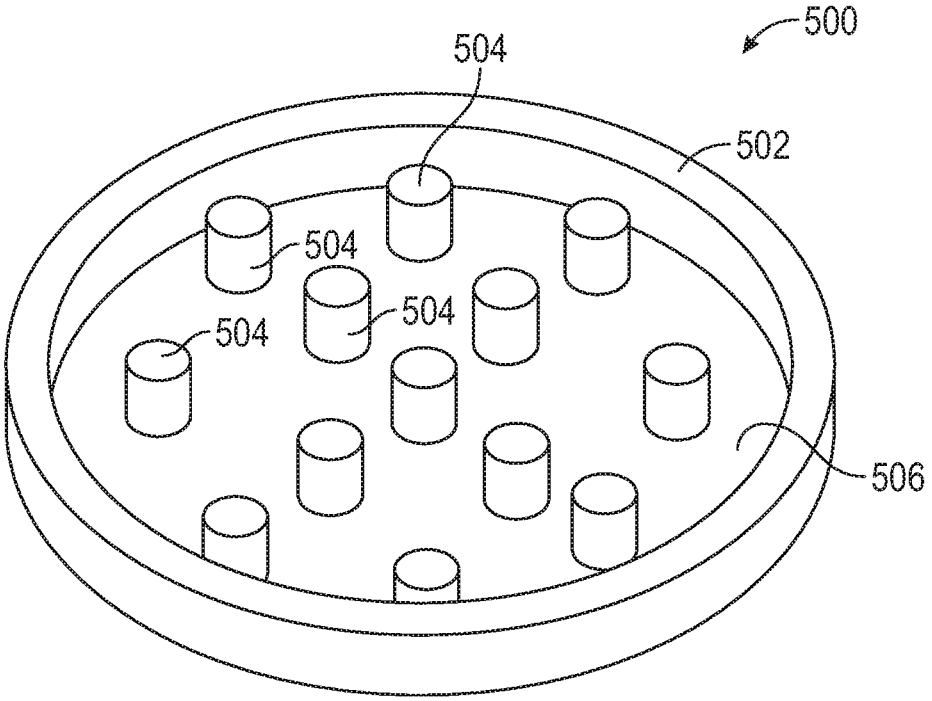
FIG. 5 is a perspective view of another example of a support brace.

Another example of a support brace 500 is shown in FIG. 5. In this example, the support brace 500 includes a ring 502 as well as support elements 504. The support elements 504 include posts. As further shown, the support brace 500 includes a brace end 506 (e.g., plate, surface, disk, member or the like) extending across the support brace 500. The ring 502 and the support elements 504 extend from the brace end 506. In one example, the brace end 506 provides the substrate for each of the support elements 504 and the ring 502 to accordingly provide a dedicated support brace 500 for insertion between one or more of the inner closure and closure shell described herein. Optionally, the support brace 500 includes a plurality of support elements 504 such as the posts shown in FIG. 5. In another example, the support elements 504, including posts, fins or the like, are arranged in one or more positions, orientations or patterns within the support brace 500 relative to the ring 502.

Figure 6:
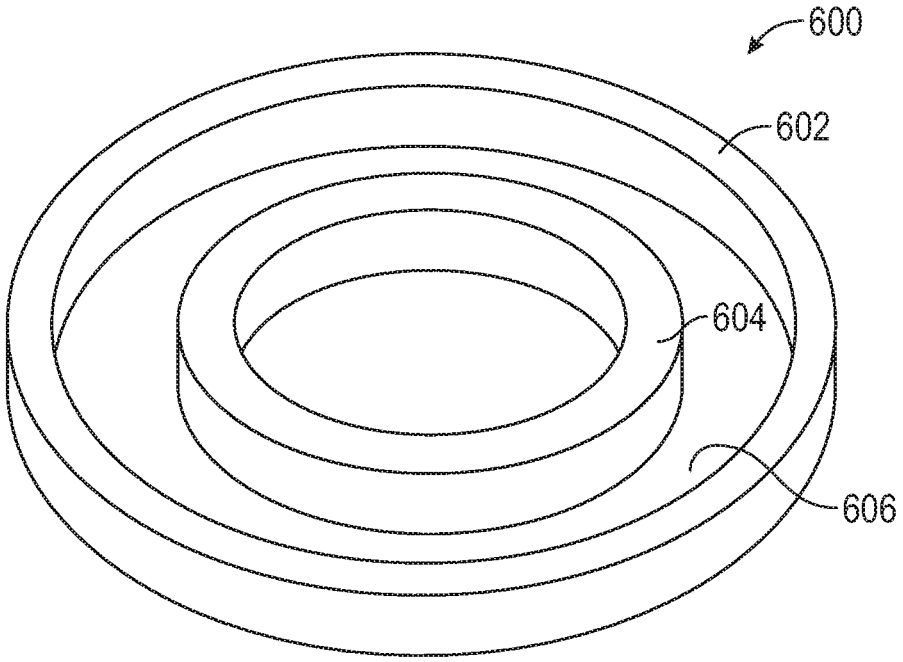
FIG. 6 is a perspective view of an additional example of a support brace.

FIG. 6 shows another example of the support brace 600. In this example, the support brace 600 includes a first ring 602 and a second ring 604. In the arrangement shown in FIG. 6, the first ring 602 is provided as an outer ring relative to the inner second ring 604. In another example, the first and second rings 602, 604 are positioned laterally, for instance, adjacent to one another, spaced from one another or the like (e.g., along the brace end 606). In the example shown in FIG. 6, the support brace 600 includes the brace end 606 and the first and second rings 602, 604 extend from the brace end 606. The support brace 600 is readily interposed between the closure shell and the inner closure, for instance, those shown in FIGS. 2A, B and FIGS. 3A, B as described herein. Optionally, the support brace 600 (or any of the support braces described herein) are provide as components (integral or separate) for either of the inner closure or closure shell.

Figure 7:
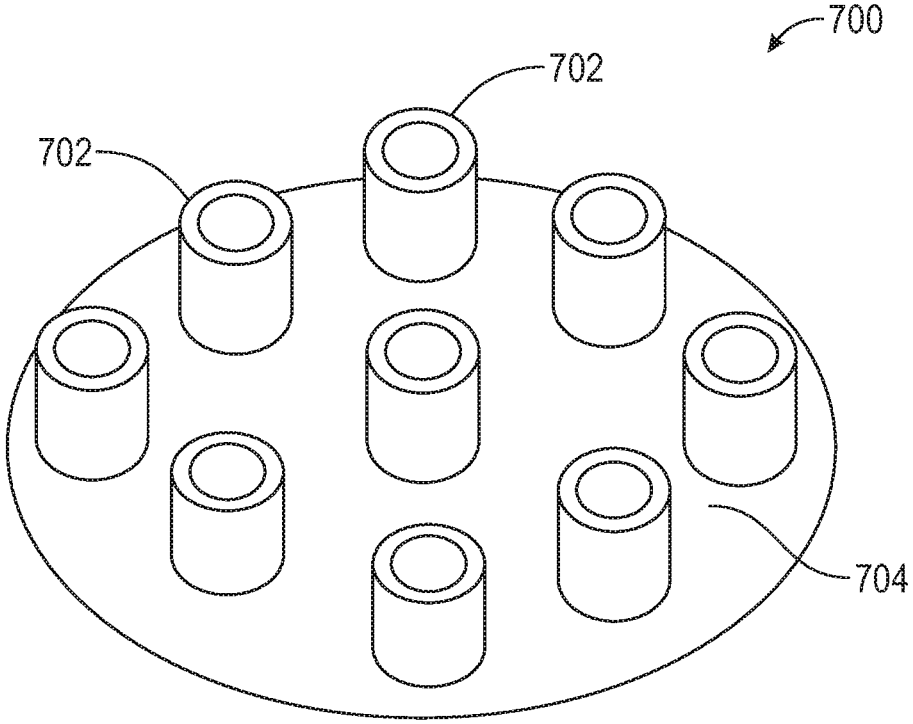
FIG. 7 is a perspective view of yet another example of a support brace.

FIG. 7 shows another example of a support brace 700. In this example, a plurality of support elements 702 including, for instance, rings are provided in a lateral arrangement, for instance, across a brace end 704. The brace end 704 is, in one example, a panel, plate or the like of a molded plastic and the support elements 702 are one or more of rings, posts or the like extending from the brace end 704. The support brace 700 is interposed between the inner closure and the closure shell as part of the assembly of the closure assembly. Optionally, the brace end 704 is a component of at least one of the inner closure or the closure shell.

As shown herein, the support braces 400-700 are, in one example, provided as separate elements relative to the inner closure and closure shell described herein. For instance, the one or more support braces 400, 700 are interposed between the closure end 214 and the shell end 208 of a composite closure assembly 200 and provides bracing to the closure shell 202, for instance during assembly of the closure shell 202 to the inner closure 204. In another example, the support braces 400-700 are included as parts of one or more of the closure shell 202 or the inner closure 204 (as well as the closure shell 202 and inner closure 304 shown, for instance, in FIG. 3A). In such an example, components such as the brace ends are included in one or more of the closure end 214, shell end 208 or the like. The one or more support elements including, for instance, the rings described herein, support elements such as posts, fins, walls or the like, extend from one or more of the closure end 214 or the shell end 208 to brace the closure shell 202 and substantially prevent (e.g., minimize or eliminate) damage to the closure shell 202 including, but not limited to, crushing, deformation, damaging, scraping or the like of the closure shell 202 during one or more of assembly to the inner closure 204 (or 304) or coupling of the assembly 200 to a container.

FIG. 8 shows another example of a closure assembly 800 including an inner closure 804 (shown in broken lines) surrounded by a closure shell 802. In this example, the closure assembly 800 is shown during assembly of the closure shell 202 to the inner closure 804. As shown an assembly force 808, for instance a downward force, is applied to the closure shell 802 to seat the closure shell 802 around the inner closure 804. The closure assembly 800 does not include a support brace described herein. In another example, the assembly force 808 includes downward and rotational forces applied to the closure assembly to couple the assembly with a container. In this example, the assembly force 808 overcomes the structural integrity of the closure shell 802 (e.g., an aluminum or tin) and deforms or crushes the closure shell 802. The deformed closure shell 802 is shown in FIG. 8 with the crushed portion 806. The closure assembly 800 is not suitable for use and accordingly is discarded (along with any other assemblies in a batch that are also deformed). Further, if the closure assembly 800 is damaged during assembly to a container the container is also discarded in some examples.

With the support braces described herein, for instance, as shown in FIGS. 2A-7, the closure shell 802 is supported relative to the inner closure 804 and damage to the closure shell is substantially prevented (e.g., minimized or eliminated). Accordingly, with use of a support brace, whether a dedicated insert between the closure shell 802 and the inner closure 804 or by way of inclusion of the support brace as a component of the closure shell 802 or the inner closure 804, damage of the closure assembly 800 is substantially prevented (e.g., minimized or eliminated).

Figure 9:
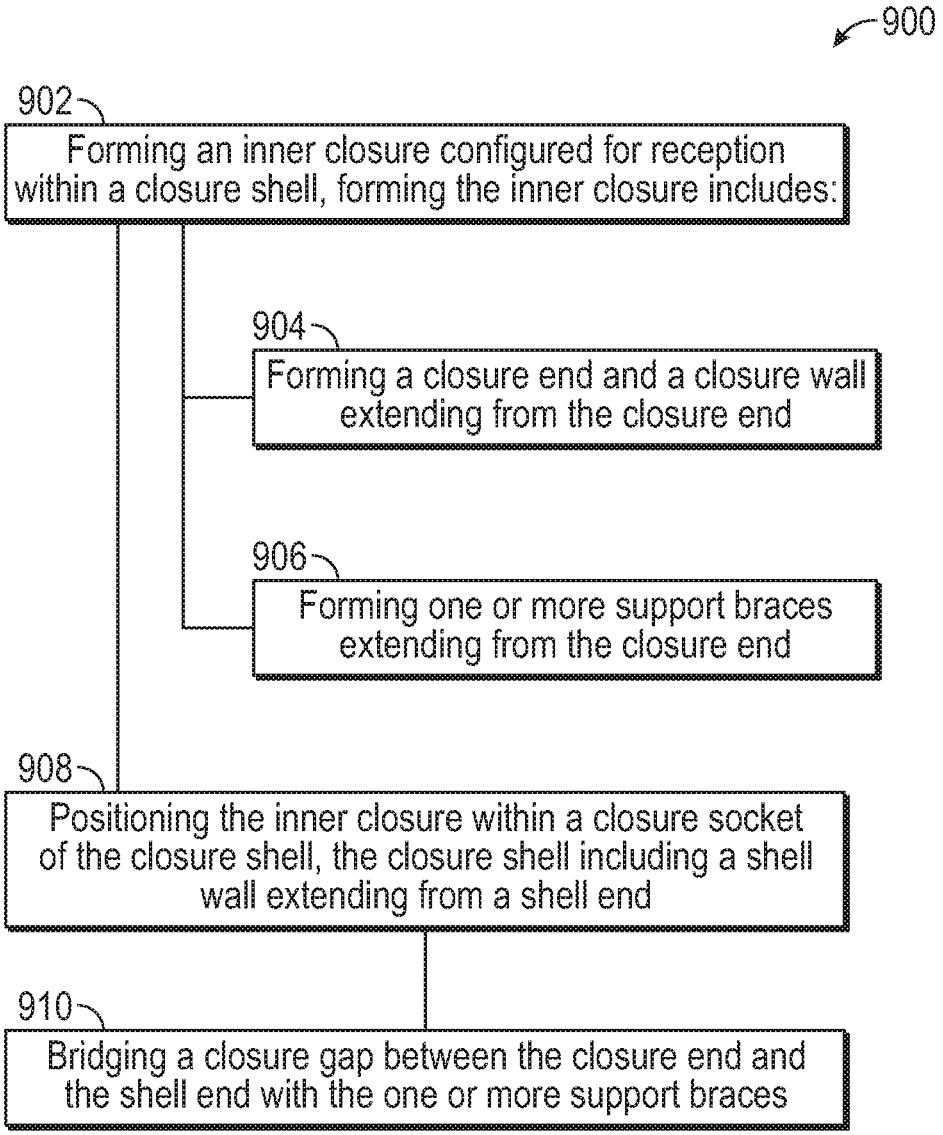
FIG. 9 is a block diagram showing one example of a method of making a composite closure assembly.

FIG. 9 shows one example of a method 900 for making a composite closure assembly, such as one or more of the composite closure assemblies 100, 200 described herein. In describing the method 900, reference is made to one or more components, features, functions, steps or the like described herein. Where convenient, reference is made to the components, features, functions, steps and the like with reference numerals. Reference numerals provided are exemplary and are not exclusive. For instance, the features, components, functions, steps and the like described in the method 900 include, but are not limited to, the corresponding numbered elements, the corresponding features described herein (both numbered and unnumbered) as well as their equivalents.

At 902, the method 900 includes forming an inner closure such as the inner closure 204 configured for reception within a closure shell 202. In one example, forming the inner closure includes at 904 forming a closure end 214 and a closure wall 212 extending from the closure end 214. For instance, the inner closure is formed by one or more of machining, cold forming, punching, molding or the like. In another example, the method 900 includes at 906 forming one or more support braces such as the one or more support braces 216 shown in FIG. 2A. As described herein the support braces 216 optionally extending from the closure end 214. In another example, the method 900 includes forming one or more support braces 216 extending from a portion of the closure shell such as the shell end 208. In still another example, the one or more support braces 216 are provided as a separate component interposed between each of the closure shell 202 and the inner closure 204 (e.g., between the shell end 208 and the closure end 214).

At 908, the inner closure 204 is positioned within a closure socket 203 of the closure shell 202. The closure shell 202 includes a shell wall 206 extending from a shell end 208. At 910 a closure gap, for instance, a closure gap 226 shown in FIG. 2B, is bridged between the closure end 214 and the shell end 208 with the one or more support braces 216. As previously described herein, bridging of the closure gap with the one or more support braces 216 (extending from one or more of the closure end 214 or the shell end 208 or separately provided therebetween) braces the closure shell 202 and substantially minimizes (e.g., minimizes or eliminates) damage to the composite closure assembly, such as the closure shell 202, for instance during one or more of assembly of the composite closure assembly 200, coupling of the assembly 200 with a container or the like.

Several options for the method 900 follow. In one example, positioning the inner closure 204 within the closure socket 203 includes applying a downward force, for instance, an assembly force 808 as shown in FIG. 8 to the closure shell 202. The method 900 further includes bracing the closure shell 202 against the downward force 808 with the one or more support braces 216. In another example, bridging the closure gap includes engaging the one or more support braces 216 with the shell end 208.

In another example, forming the one or more support braces 216 includes forming a plurality of support braces along one or more of the closure end 214, the shell end 208 or as a separate component. Optionally, forming the one or more support braces 216 includes forming one or more of fins where each of the fins of the one or more fins extends from an inner end remote from the closure wall (e.g., an interior portion of one or more of the shell end 208 or the closure end 214) to an outer end near one or more of the closure wall 212 or the shell wall 206. Optionally, forming one or more support braces 216 consists of one or more of forming fins, posts, rings, walls or the like between the closure shell 202 and the inner closure 204.

As previously described herein, in one example, the support braces 216 in any of the configurations described herein are formed as a separate component, for instance, an insert interposed between the inner closure 204 and the closure shell 202. Optionally the one or more support braces 216 (again in one or more of the variations described herein) are formed as integral components, for instance, previously coupled or integrally formed with one or more of the closure shell 202 or the inner closure 204 and thereafter engaged with the opposing component, for instance, the other of the inner closure 204 or the closure shell 202 during assembly.

In another example, the method 900 further includes fixing the inner closure 204 with the closure shell 202. Optionally, fixing the inner closure 204 with the closure shell 202 includes adhering the inner closure 204 with the closure shell 202. In still another example, fixing the inner closure with the closure shell includes mechanically engaging the closure shell 202 with the inner closure 204, for instance, by forming (e.g., rolling, crimping, clamping, deforming or the like) one or more components of the closure shell 202 or the inner closure 204 relative to the other component. In still another example, the one or more support braces 216 are fixed relative to one or more of the inner closure 204 or the closure shell 202, for instance, by way of interfitting components such as recesses, complimentary shaped ridges, adhesives or the like.

Various Notes & Examples

Example 1 can include subject matter such as a composite closure assembly comprising: a closure shell including a closure socket surrounded by a shell wall and a shell end; an inner closure within the closure socket, the inner closure fixed to the closure shell, the inner closure includes: a closure wall, a closure end, and a support brace extending from the closure end toward the shell end; and wherein a closure gap is between the shell end and the closure end, and the support brace is engaged with the shell end and bridges the closure gap.

Example 2 can include, or can optionally be combined with the subject matter of Example 1, to optionally include wherein the support brace includes a plurality of support braces extending from the closure end.

Example 3 can include, or can optionally be combined with the subject matter of one or any combination of Examples 1 or 2 to optionally include wherein the plurality of support braces consists of one or more of fins, posts, walls or rings.

Example 4 can include, or can optionally be combined with the subject matter of one or any combination of Examples 1-3 to optionally include wherein each of the support braces of the plurality of support braces includes: an inner end remote from the closure wall, an outer end near the closure wall, and a brace wall extending between the inner and outer ends.

Example 5 can include, or can optionally be combined with the subject matter of one or any combination of Examples 1-4 to optionally include wherein the brace wall is curved.

Example 6 can include, or can optionally be combined with the subject matter of Examples 1-5 to optionally include an adhesive between the closure wall and the shell wall.

Example 7 can include, or can optionally be combined with the subject matter of Examples 1-6 to optionally include wherein a closure socket height corresponds to an inner closure height.

Example 8 can include, or can optionally be combined with the subject matter of Examples 1-7 to optionally include wherein the inner closure height includes both a support brace height and a closure wall height.

Example 9 can include, or can optionally be combined with the subject matter of Examples 1-8 to optionally include wherein a closure gap height corresponds to a support brace height.

Example 10 can include, or can optionally be combined with the subject matter of Examples 1-9 to optionally include wherein the inner closure extends the entirety of a closure socket height, and a closure open end of the inner closure is flush with a shell open end of the closure shell.

Example 11 can include, or can optionally be combined with the subject matter of Examples 1-10 to optionally include wherein an interior surface of the closure wall includes threading.

Example 12 can include, or can optionally be combined with the subject matter of Examples 1-11 to optionally include a container, and the container is coupled along an interior surface of the closure wall.

Example 13 can include, or can optionally be combined with the subject matter of Examples 1-12 to optionally include a mechanical engagement between a shell wall of the closure shell and the closure wall.

Example 14 can include, or can optionally be combined with the subject matter of Examples 1-13 to optionally include wherein the mechanical engagement includes a rolled shell lip of the shell wall extend around a closure lip of the closure wall.

Example 15 can include, or can optionally be combined with the subject matter of Examples 1-14 to optionally include a composite closure assembly comprising: a closure shell including a closure socket surrounded by a shell wall and a shell end; an inner closure within the closure socket, the inner closure fixed to the closure shell, the inner closure includes: a closure wall, and a closure end; a closure gap is between the shell end and the closure end; and a support brace extends from the closure end to the shell end, and the support brace bridges the closure gap.

Example 16 can include, or can optionally be combined with the subject matter of Examples 1-15 to optionally include wherein the support brace includes a plurality of support braces extending from the closure end.

Example 17 can include, or can optionally be combined with the subject matter of Examples 1-16 to optionally include wherein the support brace consists of one or more of fins, posts, walls or rings.

Example 18 can include, or can optionally be combined with the subject matter of Examples 1-17 to optionally include wherein the support brace includes: an inner end remote from the closure wall, an outer end near the closure wall, and a brace wall extending between the inner and outer ends.

Example 19 can include, or can optionally be combined with the subject matter of Examples 1-18 to optionally include wherein the brace wall is curved.

Example 20 can include, or can optionally be combined with the subject matter of Examples 1-19 to optionally include wherein the support brace includes a ring and a plurality of support elements extending from the ring.

Example 21 can include, or can optionally be combined with the subject matter of Examples 1-20 to optionally include an adhesive between the closure wall and the shell wall.

Example 22 can include, or can optionally be combined with the subject matter of Examples 1-21 to optionally include wherein a closure socket height corresponds to an inner closure height.

Example 23 can include, or can optionally be combined with the subject matter of Examples 1-22 to optionally include wherein the inner closure height includes both a support brace height and a closure wall height.

Example 24 can include, or can optionally be combined with the subject matter of Examples 1-23 to optionally include wherein a closure gap height corresponds to a support brace height.

Example 25 can include, or can optionally be combined with the subject matter of Examples 1-24 to optionally include wherein the inner closure extends the entirety of a closure socket height, and a closure open end of the inner closure is flush with a shell open end of the closure shell.

Example 26 can include, or can optionally be combined with the subject matter of Examples 1-25 to optionally include wherein an interior surface of the closure wall includes threading.

Example 27 can include, or can optionally be combined with the subject matter of Examples 1-26 to optionally include a container, and the container is coupled along an interior surface of the closure wall.

Example 28 can include, or can optionally be combined with the subject matter of Examples 1-27 to optionally include a mechanical engagement between a shell wall of the closure shell and the closure wall.

Example 29 can include, or can optionally be combined with the subject matter of Examples 1-28 to optionally include wherein the mechanical engagement includes a rolled shell lip of the shell wall extending around a closure lip of the closure wall.

Example 30 can include, or can optionally be combined with the subject matter of Examples 1-29 to optionally include a composite closure assembly comprising: a closure shell including a closure socket surrounded by a shell wall and a shell end; an inner closure within the closure socket, the inner closure fixed to the closure shell, the inner closure includes a closure wall and a closure end; a closure gap is between the shell end and the closure end; and a support brace extends from the closure end to the shell end, and bridges the closure gap, the support brace includes: two or more support elements, the support elements include at least one element gap therebetween, and at least one ring support extending across the at least one element gap.

Example 31 can include, or can optionally be combined with the subject matter of Examples 1-30 to optionally include wherein the at least one ring support extends around the support elements.

Example 32 can include, or can optionally be combined with the subject matter of Examples 1-31 to optionally include wherein the support elements consist of one or more of fins, ribs, walls or posts.

Example 33 can include, or can optionally be combined with the subject matter of Examples 1-32 to optionally include wherein support elements extend from the ring support inwardly toward a support brace interior.

Example 34 can include, or can optionally be combined with the subject matter of Examples 1-33 to optionally include wherein each of the support elements includes: an inner end proximate the support brace interior, and a brace wall extending between the ring support and the inner end.

Example 35 can include, or can optionally be combined with the subject matter of Examples 1-34 to optionally include wherein the support element is curved.

Example 36 can include, or can optionally be combined with the subject matter of Examples 1-35 to optionally include an adhesive between the closure wall and the shell wall.

Example 37 can include, or can optionally be combined with the subject matter of Examples 1-36 to optionally include wherein a closure socket height corresponds to an inner closure height.

Example 38 can include, or can optionally be combined with the subject matter of Examples 1-37 to optionally include wherein the inner closure height includes both a support brace height and a closure wall height.

Example 39 can include, or can optionally be combined with the subject matter of Examples 1-38 to optionally include wherein a closure gap height corresponds to a support brace height.

Example 40 can include, or can optionally be combined with the subject matter of Examples 1-39 to optionally include a mechanical engagement between a shell wall of the closure shell and the closure wall.

Example 41 can include, or can optionally be combined with the subject matter of Examples 1-40 to optionally include wherein the mechanical engagement includes a rolled shell lip of the shell wall extend around a closure lip of the closure wall.

Example 42 can include, or can optionally be combined with the subject matter of Examples 1-41 to optionally include a container, and the container is coupled along an interior surface of the closure wall.

Example 43 can include, or can optionally be combined with the subject matter of Examples 1-42 to optionally include a method of making a composite closure assembly comprising: forming an inner closure configured for reception within a closure shell, forming the inner closure includes: forming a closure end and a closure wall extending from the closure end, and forming one or more support braces extending from the closure end; positioning the inner closure within a closure socket of a closure shell, the closure shell including a shell wall extending from a shell end; and bridging a closure gap between the closure end and the shell end with the one or more support braces.

Example 44 can include, or can optionally be combined with the subject matter of Examples 1-43 to optionally include wherein positioning the inner closure within the closure socket includes: applying a downward force on the closure shell, and bracing the closure shell against the downward force with the one or more support braces.

Example 45 can include, or can optionally be combined with the subject matter of Examples 1-44 to optionally include wherein bridging includes engaging the one or more support braces with the shell end.

Example 46 can include, or can optionally be combined with the subject matter of Examples 1-45 to optionally include wherein forming the inner closure includes molding the inner closure.

Example 47 can include, or can optionally be combined with the subject matter of Examples 1-46 to optionally include wherein forming one or more support braces includes forming a plurality of support braces along on the closure end.

Example 48 can include, or can optionally be combined with the subject matter of Examples 1-47 to optionally include wherein forming one or more support braces includes forming one or more fins, each fin of the one or more fins extending from an inner end remote from the closure wall to an outer end near the closure wall.

Example 49 can include, or can optionally be combined with the subject matter of Examples 1-48 to optionally include wherein forming one or more support braces consists of one or more of forming fins, forming posts, forming walls or forming rings.

Example 50 can include, or can optionally be combined with the subject matter of Examples 1-49 to optionally include fixing the inner closure with the closure shell.

Example 51 can include, or can optionally be combined with the subject matter of Examples 1-50 to optionally include wherein fixing the inner closure with the closure shell includes adhering the inner closure with the closure shell.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A composite closure assembly comprising:

a closure shell including a closure socket surrounded by a shell wall and a shell end;

an inner closure within the closure socket, the inner closure fixed to the closure shell, the inner closure includes:

a closure wall; and a closure end;

wherein the closure shell is fixed relative to the inner closure in both a closure configuration and a removal configuration from a container;

a closure gap is between the shell end and the closure end; and a plurality of support braces or a support brace including a plurality of support elements extending from the closure end, wherein the closure gap is between and extends around each of the plurality of adjacent support braces or the support elements, and the one or the plurality of support braces extending from the closure end to the shell end and bridging the closure gap.

2. The composite closure assembly of claim 1, wherein the support brace is integral with the inner closure.

3. The composite closure assembly of claim 1, wherein the support brace consists of one or more of fins, posts, walls or rings.

4. The composite closure assembly of claim 1, wherein the support brace includes:

an inner end remote from the closure wall;

an outer end near the closure wall; and a brace wall extending between the inner and outer ends.

5. The composite closure assembly of claim 1, wherein the support brace includes a ring and a plurality of support elements extending from the ring.

6. The composite closure assembly of claim 1, wherein a closure socket height corresponds to an inner closure height.

7. The composite closure assembly of claim 6, wherein the inner closure height includes both a support brace height and a closure wall height.

8. The composite closure assembly of claim 6, wherein a closure gap height corresponds to a support brace height.

9. The composite closure assembly of claim 1 comprising the container, and the container is coupled along an interior surface of the closure wall.

10. The composite closure assembly of claim 1 comprising a mechanical engagement between a shell wall of the closure shell and the closure wall.

11. The composite closure assembly of claim 10, wherein the mechanical engagement includes a rolled shell lip of the shell wall extending around a closure lip of the closure wall.

12. The composite closure assembly of claim 1, wherein the composite closure assembly includes a closing configuration and a removal configuration:

in the closing configuration the composite closure assembly is configured for coupling with and closing the container; and in the removal configuration the closure shell is statically fixed with the inner closure.

13. The composite closure assembly of claim 12 wherein the removal configuration includes rotation of the closure assembly with respect to the container.

14. The composite closure assembly of claim 1, wherein in the closure shell is in nonrotatable contact with respect to the inner closure.

15. The composite closure assembly of claim 1, wherein the closure shell is fixed in the same position relative to the inner closure in the closure configuration and the removal configuration.

16. A composite closure assembly comprising:

a closure shell including a closure socket surrounded by a shell wall and a shell end;

an inner closure within the closure socket, the inner closure fixed to the closure shell, the inner closure includes:

a closure wall; and a closure end;

a closure gap is between the shell end and the closure end;

a support brace extends from the closure end to the shell end, and bridges the closure gap, the support brace includes:

two or more support elements, the support elements include at least one element gap;

wherein the at least one element gap is between each of the support elements; and at least one ring support extending across the at least one element gap; and wherein the closure shell is coupled in a mechanically fixed configuration with respect to the inner closure as one piece during assembly and while removing the composite closure assembly from a container.

17. The composite closure assembly of claim 16, wherein the at least one ring support extends around the support elements.

18. The composite closure assembly of claim 16, wherein support elements extend from the ring support inwardly toward a support brace interior.

19. The composite closure assembly of claim 18, wherein each of the support elements includes:

an inner end proximate the support brace interior; and a brace wall extending between the ring support and the inner end.

20. The composite closure assembly of claim 16, wherein the support element is curved.

21. The composite closure assembly of claim 16 comprising the container, and the container is coupled along an interior surface of the closure wall.

22. The composite closure assembly of claim 16, wherein the composite closure assembly includes a closing configuration and a removal configuration:

in the closing configuration the composite closure assembly is configured for coupling with and closing a container; and in the removal configuration the closure shell is statically fixed with the inner closure.

23. The composite closure assembly of claim 22 wherein the removal configuration includes rotation of the closure assembly with respect to the container.

24. The composite closure assembly of claim 16, wherein in the closure shell is in nonrotatable contact with the inner closure.

25. A method of making a composite closure assembly comprising:

forming an inner closure configured for reception within a closure shell, forming the inner closure includes:

forming a closure end and a closure wall extending from the closure end;

forming one or more support braces extending from the closure end; and wherein forming the one or more support braces includes forming a gap bewteen the one or more support braces and an adjacent one or more support braces;

positioning the inner closure within a closure socket of a closure shell, the closure shell including a shell wall extending from a shell end;

bridging a closure gap between the closure end and the shell end with the one or more support braces including the gap between the one or more support braces and the adjacent one or more support braces; and mechanically fixing the inner closure to the closure shell in both a closed configuration and in a removal configuration from a container.

26. The method of claim 25, wherein positioning the inner closure within the closure socket includes:

applying a downward force on the closure shell; and bracing the closure shell against the downward force with the one or more support braces.

27. The method of claim 25, wherein bridging includes engaging the one or more support braces with the shell end.

28. The method of claim 25, wherein forming the inner closure includes molding the inner closure.

29. The method of claim 25, wherein forming one or more support braces includes forming a plurality of support braces along the closure end.

30. The method of claim 25, wherein forming one or more support braces includes forming one or more fins, each fin of the one or more fins extending from an inner end remote from the closure wall to an outer end near the closure wall.

31. The method of claim 25, wherein fixing the inner closure with the closure shell includes adhering the inner closure with the closure shell.

32. The method of claim 25 comprising fixing the closure shell in static configuration with the inner shell.

33. The method of claim 25 comprising fixing the closure shell in nonrotatable contact with the inner shell.

* * * * *